US005255533A

United States Patent [19]

Reilly

[11] Patent Number: 5,255,533

[45] Date of Patent: Oct. 26, 1993

[54] ICE BOX FOR SPHERICAL DRINK CONTAINER

[76] Inventor: Sean E. Reilly, 25346 Avenida Cappela, Valencia, Calif. 91355

[21] Appl. No.: 996,527

[22] Filed: Dec. 17, 1992

[51] Int. Cl.[5] ..... B67D 5/62

[52] U.S. Cl. ..... 62/400; 62/372; 62/457.2; 62/464

[58] Field of Search ..... 62/371, 372, 389, 400, 62/529, 530, 457.2, 459, 463, 464, 457.1

[56] References Cited

U.S. PATENT DOCUMENTS 3,506,161 4/1970 Saint-Dizier ..... 62/400
3,789,622 2/1974 Yanes ..... 62/400

*Primary Examiner*—John M. Sollecito
*Attorney, Agent, or Firm*—Gene W. Arant

[57] ABSTRACT

An ice box is shown for storing and cooling a spherical container for carbonated drinks, of the type often referred to as a "party ball", which is characterized by a radial protrusion extending from a normally upper surface and having a pair of openings for attachment of a pump thereto. An ice box for storing and transporting a party ball includes a housing for completely surrounding both the party ball and a quantity of ice in which it is packed, a first removable cover forming an opening in the housing for insertion of a pump, and spacers on the interior of the housing maintained in position by the removable cover for ensuring that the pump-attachment protrusion is aligned with the opening. A second removable cover may also be used to provide access to the interior of the housing for adding ice without disturbing the alignment of the pump-attachment protrusion.

12 Claims, 3 Drawing Sheets

FIG. 4
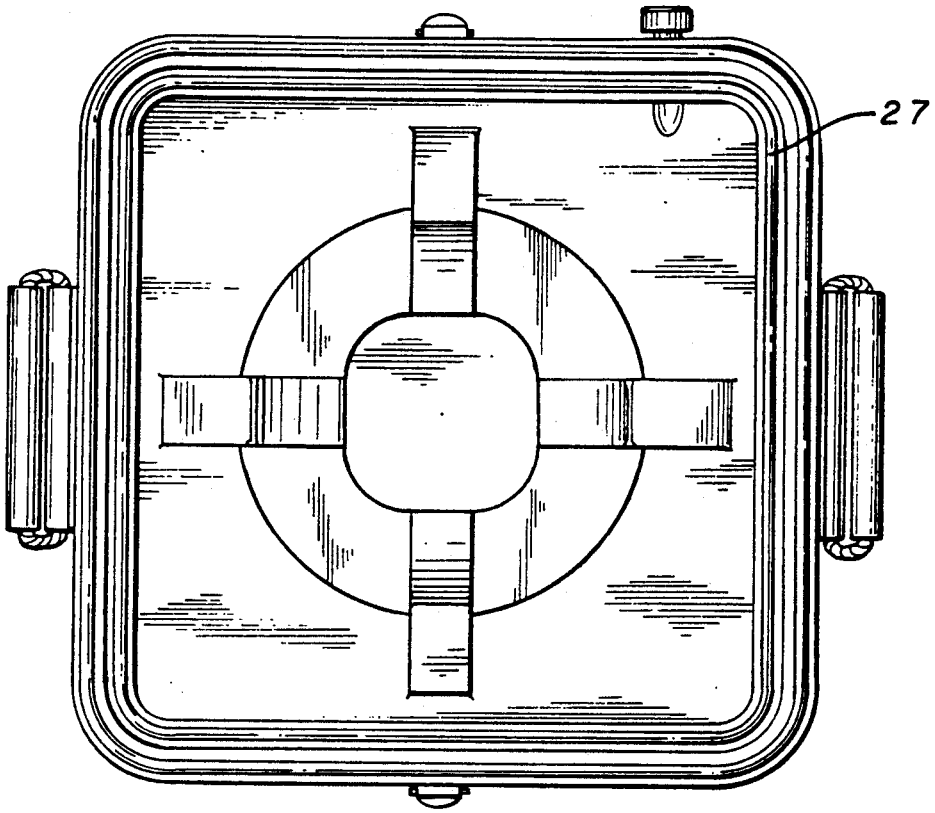
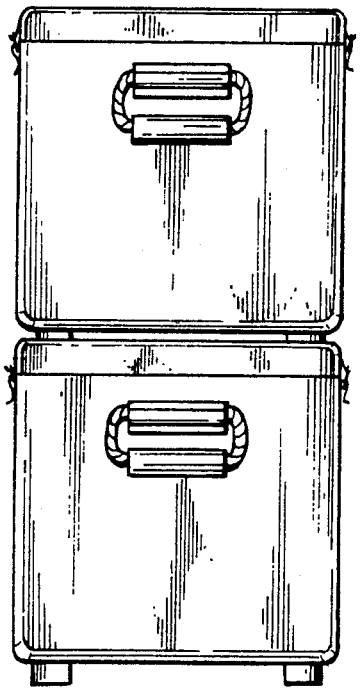
FIG. 5

ICE BOX FOR SPHERICAL DRINK CONTAINER

FIELD OF THE INVENTION

The invention pertains to an ice box assembly for storing, transporting, and cooling a spherical drink container.

1. Background of the Invention

In recent years spherical containers for carbonated drinks have come into fairly widespread usage. Such containers, often referred to as "party balls", are characterized by a radial protrusion extending from a normally upper surface and having a pair of openings for attachment of a pump thereto. The tasks of providing cold storage for this type of container, of transporting it in a cold condition, and of then conveniently dispensing its contents, present unique requirements which have not heretofore been successfully addressed.

2. Prior Art

U.S. Pat. No. 3,506,131 issued Apr. 14, 1970 to Saint-Dizier for "Apparatus for Dispensing Carbonated Beverages".

U.S. Pat. No. 3,627,399 issued Dec. 14, 1971 to Addison et al for "Portable Cooler and Support for a Pressurized Keg".

U.S. Pat. No. 3,789,622 issued Feb. 5, 1974 to Yanes for "Ice Box for Beer Barrel".

U.S. Pat. No. 4,042,142 issued Aug. 16, 1977 to Ruano for "Beer Keg Cooling Container".

U.S. Pat. No. 4,071,160 issued Jan. 31, 1978 to Vick for "Insulated Beer Keg Container".

The prior patent which appears to be most pertinent to the present invention is the Saint-Dizier U.S. Pat. No. 3,506,131 which shows an upright barrel 1 housed in a generally cubical container 3 having a removable top lid 5. A copy of that reference is submitted with this application.

SUMMARY OF THE INVENTION

According to the invention an ice box for storing and transporting a party ball includes a housing for completely surrounding both the party ball and a quantity of ice in which it is packed, first removable means forming an opening in the housing for insertion of a pump therein, and spacing means on the interior of the housing for ensuring that the pump-attachment protrusion is aligned with the opening.

In its preferred form the invention also includes second removable means providing access to the interior of the housing for adding ice thereto without disturbing the alignment of the pump-attachment protrusion.

DRAWING SUMMARY

FIG. 4 is a top plan view of the box and lower spider; and

FIG. 5 is an elevation view showing how two of the boxes stack together.

DETAILED DESCRIPTION (FIGS. 1–5)

Figure 1:
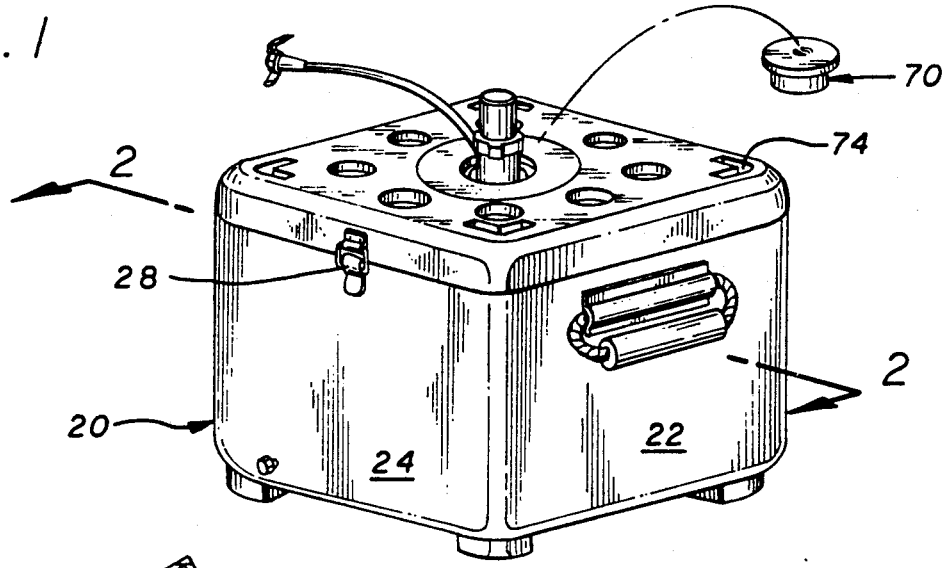
FIG. 1 is a perspective view of the presently preferred form of my new ice box assembly when a party ball and pump have been installed therein.
Figure 1:
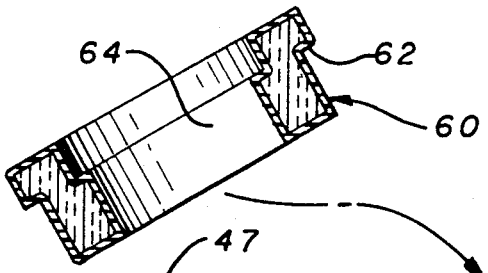
Figure 2:
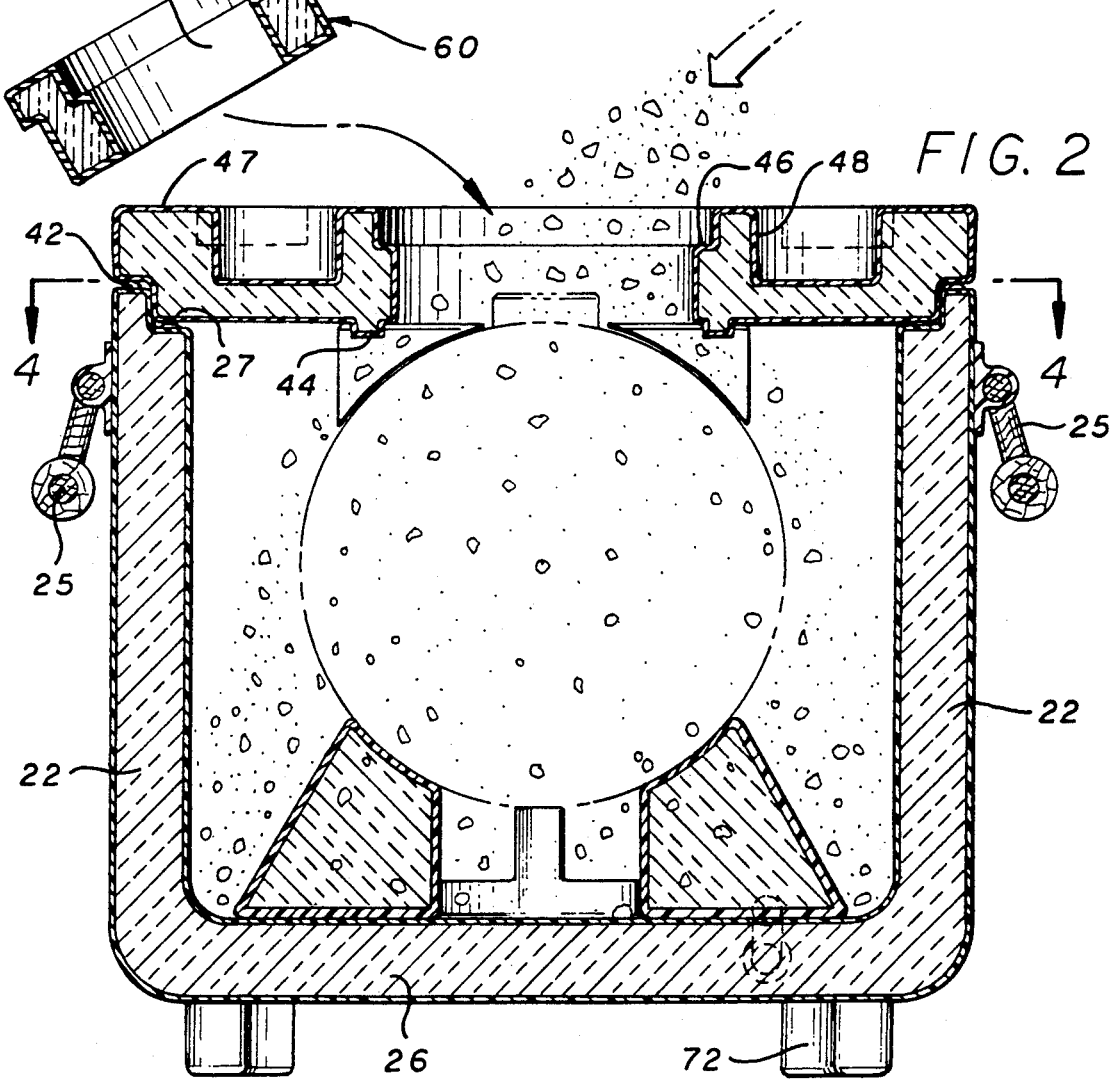
FIG. 2 is a vertical cross-sectional view taken on Line 2—2 of FIG. 1.
Figure 3:
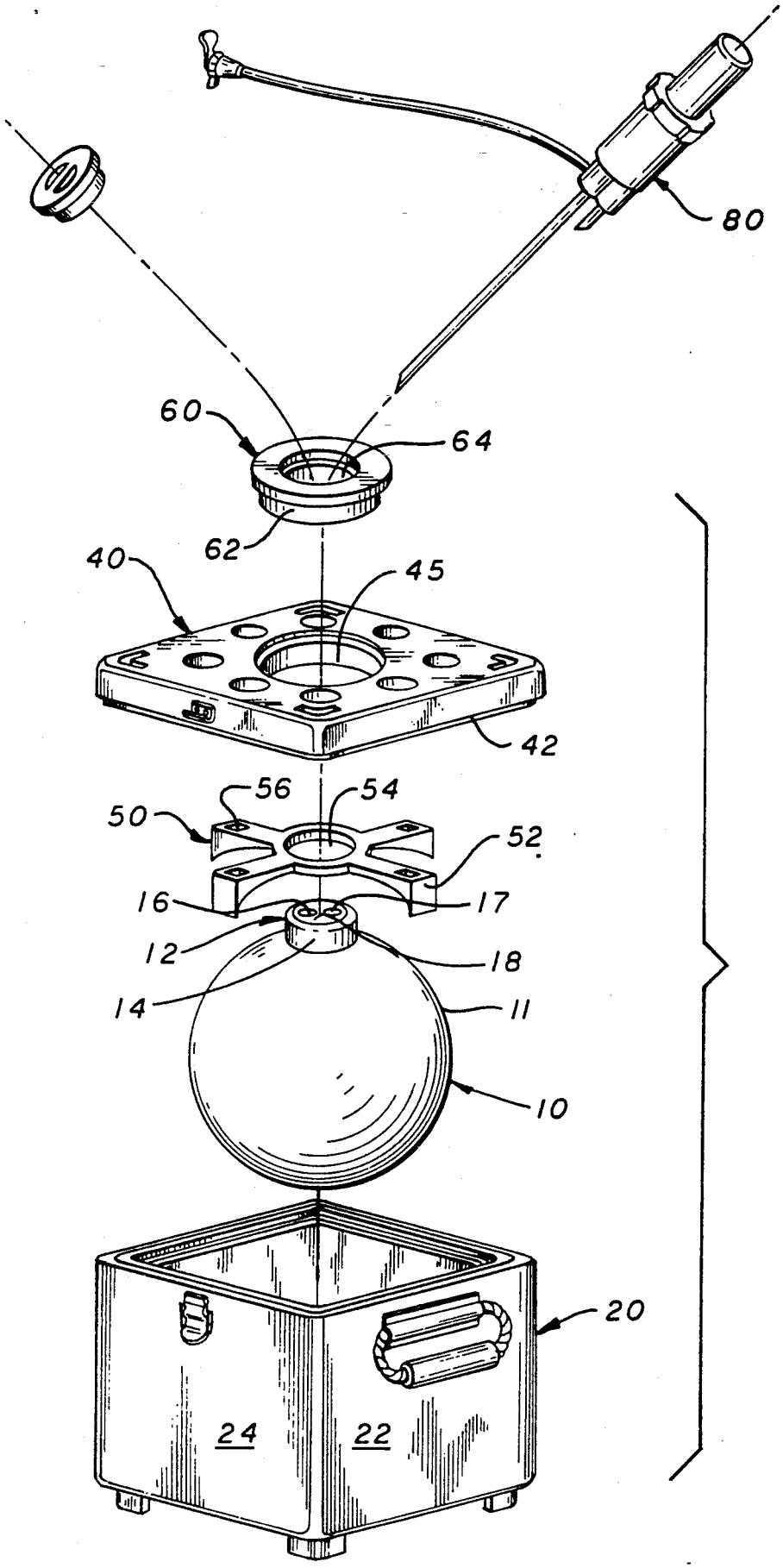
FIG. 3 is an exploded perspective view of the pump, ice box lids, upper spider, and party ball when removed from the box itself.

Referring now to the drawings, FIGS. 1 through 5, the presently preferred embodiment of my invention is shown in detail. First, however, a brief description of the party ball will be given.

Party ball 10 is substantially spherical in shape and normally contains a carbonated beverage such as beer or a soft drink. On its normally upper surface 11 there is protrusion 12 which is adapted for attachment of a pump. The protrusion 12 has an outer cylindrical wall 14, and in its end face 15 are formed two openings 16 and 17, one being for drawing liquid from the ball and the other being for returning air to the ball. A flat sheet 18 with adhesive material on its under side forms a seal member that normally covers the openings 16 and 17, prior to obtaining access to the contents of the container. The seal member is then removed and thrown away, and the container's contents, if any are left, would have to be resealed by other means.

An open-topped plastic box 20 is of generally cubical shape and has parallel pairs of side walls 22, 24, and a bottom wall 26. Gripping handles 25 are attached to the outer surfaces of the side walls 22. All of the side walls have a downwardly recessed interior shoulder 27 which therefore extends around the entire periphery of the box.

A lower spider structure 30 normally rests upon the upper surface of the bottom wall 26 and is selectively removable from the box 20, to make it available for other uses, such as an ordinary ice box used for purposes other than holding a party ball. The lower spider structure 30 includes a plurality of spacer feet 32 which are disposed circumferentially upon the upper surface of the bottom wall 26 and extend upwardly therefrom. When the party ball 10 is inserted into the box 30, it is therefore cradled by the upper surfaces of the spacer feet 32, which engage the lower surface of the drink container and thereby support the drink container in a horizontally centered relationship.

A main lid 40 is adapted to closingly engage the open top of the box 20. The bottom side of the lid is recessed at 42 on all four of its edges, and abuts the tops of wide walls 22 and engages the shoulder 27 in a sealing relationship. Main lid 40 also has a central opening 45 therein. The upper portion of the wall of opening 45 is recessed to form a circumferential shoulder 46. The top surface 47 of lid 40 has various recesses 48 which may act as cup holders.

An upper spider structure 50 has a plurality of circumferentially arranged spacer fingers 52 adapted to engage the upper surface of the drink container 10 about the circumference of the pump-attachment protrusion 12. The upper spider structure 50 also has a central opening 54 for receiving the pump-attachment protrusion 12.

On the bottom side of lid 40 there are four downward protrusions 44 which engage with corresponding recesses 56 in the upper surfaces of the respective spacer fingers 52 of spider 50, for maintaining the pump-attachment protrusion 12 in a horizontally centered relationship relative to the top of box 20.

An auxiliary lid 60 is adapted to closingly engage the central opening 45 of the main lid. The outer cylindrical wall of auxiliary lid 60 is recessed at 62 to provide a circumferential shoulder that rests upon the circumferential shoulder 46 of lid 40. The auxiliary lid also has a central opening 64 therein for installing a pump 80 therethrough to provide access to the contents of the drink container.

An important advantage of this arrangement is that the auxiliary lid 60 is selectively removable for adding ice to the interior of the ice box 20 without disturbing the alignment of the pump-attachment protrusion 12.

A cap 70 is also provided for selectively closing the central opening 64 of the auxiliary lid, when the party ball is being stored or transported, or when the box 20 is used as an ordinary ice box.

Walls 24 are provided with latches 28 which have mating parts on the associated edges of the main lid 40.

FIG. 5 shows how legs 72 underneath bottom wall 26 of the box 20 interfit with recesses 74 in the top of main lid 40, when it is desired to stack two or more of the boxes vertically.

Although the presently preferred form of my invention has been disclosed in some detail, it will be understood that many variations are possible within the spirit and scope of the invention. A detailed disclosure of the presently preferred embodiment has been made in order to comply with requirements of the patent laws, but the scope of the invention is to be measured only in accordance with the appended claims.

What I claim is:

1. Apparatus for storing and cooling a drink container that is essentially spherical in shape and also has a normally upper surface with a radial protrusion extending therefrom for attachment of a pump thereto, comprising:

an open-topped plastic box of generally cubical shape and having a bottom wall;

a plurality of spacer feet disposed circumferentially upon the upper surface of said bottom wall and extending upwardly therefrom for engaging the lower surface of the drink container and thereby supporting the drink container in a horizontally centered relationship;

a main lid which is adapted to closingly engage the open top of the box, and having a central opening therein;

a plurality of spacer fingers adapted to engage the upper surface of the drink container about the circumference of the pump-attachment protrusion;

means on the under surface of said main lid engageable with said spacer fingers for maintaining the pump-attachment protrusion in a horizontally centered relationship; and an auxiliary lid adapted to closingly engage said central opening of said main lid.

2. The apparatus of claim 1 wherein said auxiliary lid has a central opening therein for installing a pump therethrough to provide access to the contents of the drink container, and which further includes a cap for selectively closing said central opening of said auxiliary lid.

3. The apparatus of claim 1 wherein said plurality of spacer feet are integrally formed as a lower spider structure which is selectively removable from said box, thereby making said box available for other usages.

4. The apparatus of claim 1 wherein said plurality of spacer fingers are integrally formed as an upper spider structure also having a central opening for receiving said pump-attachment protrusion.

5. The apparatus of claim 2 wherein said plurality of spacer fingers are integrally formed as an upper spider structure also having a central opening for receiving said pump-attachment protrusion.

6. The apparatus of claim 3 wherein said plurality of spacer fingers are integrally formed as an upper spider structure also having a central opening for receiving said pump-attachment protrusion.

7. Apparatus for storing and cooling a drink container that is essentially spherical in shape and also has a normally upper surface with a radial protrusion extending therefrom for attachment of a pump thereto, comprising:

an open-topped plastic box of generally cubical shape and having a bottom wall;

a plurality of spacer feet disposed circumferentially upon the upper surface of said bottom wall and extending upwardly therefrom for engaging the lower surface of the drink container and thereby supporting the drink container in a horizontally centered relationship, said plurality of spacer feet being integrally formed as a lower spider structure which is selectively removable from said box;

a main lid which is adapted to closingly engage the open top of the box, and having a central opening therein;

a plurality of circumferentially arranged spacer fingers adapted to engage the upper surface of the drink container about the circumference of the pump-attachment protrusion, said plurality of spacer fingers being integrally formed as an upper spider structure which also has a central opening for receiving said pump-attachment protrusion;

means formed on the under surface of said main lid engageable with said upper spider structure for maintaining said pump-attachment protrusion in a horizontally centered relationship;

an auxiliary lid adapted to closingly engage said central opening of said main lid, said auxiliary lid having a central opening therein for installing a pump therethrough to provide access to the contents of the drink container;

said auxiliary lid being selectively removable for adding ice to the interior of said ice box without disturbing the alignment of said pump-attachment protrusion; and a cap for selectively closing said central opening of said auxiliary lid.

8. Apparatus as in claim 7 wherein said main lid has recesses formed on its upper surface to provide cup holders.

9. Drink dispensing apparatus comprising, in combination:

an ice box with an open top;

a drink container that is essentially spherical in shape and also has a normally upper surface with a radial protrusion extending therefrom having a pair of openings therein for attachment of a pump thereto, the drink container being disposed within said box with said pump-attachment protrusion extending upward within the upper portion of said ice box;

an upper spider disposed within said upper portion of said ice box, having a central opening which receives said pump-attachment protrusion and a plurality of spacer fingers which engage the upper surface of said drink container about the circumference of said pump-attachment protrusion for maintaining a desired central position of said pump-attachment protrusion;

a main lid extending over the otherwise open top of said box, having means on its underside engaging said upper spider for retaining the position of said spider and said pump-attachment protrusion, said main lid also having a central opening therein; and a pump extending through said central opening in said main lid and secured to said pump-attachment protrusion of the drink container.

10. Apparatus as in claim 9 which further includes a plurality of spacer feet disposed circumferentially upon the upper surface of said bottom wall and extending upwardly therefrom for engaging the lower surface of the drink container and thereby supporting the drink container in a horizontally centered relationship, wherein said plurality of spacer feet being integrally formed as a lower spider structure which is selectively removable from said box.

11. Apparatus as in claim 9 which further includes an auxiliary lid adapted to closingly engage said central opening of said main lid, said auxiliary lid having a central opening therein through which said pump extends, said auxiliary lid being selectively removable for adding ice to the interior of said ice box without disturbing the alignment of said pump-attachment protrusion.

12. An ice box for storing a drink container that is essentially spherical in shape and also has a radial protrusion extending from its normally upper surface with a pair of openings for attachment of a pump thereto, comprising:

housing means for completely surrounding both the container and a quantity of ice in which it is packed;

first removable means forming an opening in said housing means for insertion of a pump therein;

spacing means on the interior of said housing means for ensuring that said pump-attachment protrusion is aligned with said opening; and second removable means providing access to the interior of said housing means for adding ice thereto without disturbing the alignment of said pump-attachment protrusion.

* * * * *